US006332695B1

(12) United States Patent
Wang

(10) Patent No.: US 6,332,695 B1
(45) Date of Patent: Dec. 25, 2001

(54) ADJUSTABLE REFLECTOR ASSEMBLY FOR LUMINAIRE

(75) Inventor: James P. Wang, Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/502,794

(22) Filed: Feb. 11, 2000

(51) Int. Cl.[7] ..... F21V 17/02

(52) U.S. Cl. ..... 362/277; 362/278; 362/282; 362/284; 362/297; 362/306; 362/341; 362/433; 362/457

(58) Field of Search ..... 362/297, 346, 362/347, 368, 433, 457, 396, 277, 278, 280, 282, 284, 306, 341, 514, 320

(56) References Cited

U.S. PATENT DOCUMENTS 3,609,337 * 8/1971 Adra ..... 362/297
5,459,649 * 10/1995 Ellion ..... 362/187
5,887,969 * 3/1999 Gordin ..... 362/347

* cited by examiner

*Primary Examiner*—Stephen Husar
*Assistant Examiner*—Anabel Ton
(74) *Attorney, Agent, or Firm*—Mark S. Bicks; Jeffrey J. Howell

(57) ABSTRACT

A light fixture having an adjustable reflector is supported on a deployment bar. An actuation screw passes through the deployment bar and engages a threaded stud. Threading the actuation screw into and out of the threaded stud bends the deployment bar, which in turn pushes against the reflector adjusting the angle of the reflector.

28 Claims, 4 Drawing Sheets

ADJUSTABLE REFLECTOR ASSEMBLY FOR LUMINAIRE

FIELD OF THE INVENTION

The present invention relates to a luminaire with an adjustable reflector assembly that allows easy glare control and optical performance changes in a luminaire, while in the field. The adjustable reflector assembly has a reflector that rests on a deployment bar with ends that can be pivoted downwardly by turning a screw. Pivoting the deployment bar ends repositions the reflector relative to the lamp center, changing the optical characteristics of the luminaire by reducing high angle glare and redirecting more light downwardly.

BACKGROUND OF THE INVENTION

Luminaires with adjustable reflectors are common to the lighting industry. Typically the reflector is used to direct light into a particular region. An adjustable reflector allows the installer or user to reposition the reflector to optimally redirect the light into or away from a specific area, avoiding the need to move the existing fixture or provide another lamp.

Present day luminaires with adjustable reflectors generally require adding or changing existing components for adjustment. Other devices require removal of screws or other components to adjust the reflector then replacing the screws to secure the reflector in its new position. Some of these luminaires have adjustable reflectors with many pieces and complicated adjustment components. These adjustment procedures can be cumbersome and time consuming, making quick adjustment impracticable or impossible. In addition, the reflectors with complicated adjustment mechanisms have a higher likelihood of failure, and are difficult and expensive to manufacture.

SUMMARY OF THE INVENTION

Accordingly, an object of the present invention is to provide a luminaire with an adjustable reflector that is simple to adjust and is inexpensive and simple to manufacture.

Another object of this invention is to provide a luminaire with an adjustable reflector that can be easily adjusted without removing or adding components, and that still effectively alters the characteristics of the light.

The foregoing objects are basically attained by providing a reflector assembly that has a reflector mounted on a base and a deployment bar mounted on the base adjacent to the reflector. An actuation screw engages the reflector and the deployment bar and threads into the base. Threading the actuation screw into the base changes the position of the deployment bar and in turn changes the position of the reflector.

By forming the adjustable reflector in this manner, the reflector assembly is limited to a few easy to manufacture, cost effective parts. In addition, the reflector assembly has an adjustable reflector that can be easily adjusted in the field by any user or installer with a twist of a screw, reducing high angle glare and redirecting more light downwardly.

Other objects, advantages and salient features of the invention will become apparent from the following detailed description, which, taken in conjunction with the annexed drawings, discloses a preferred embodiment of the invention.

As used in this application, "up", "down", "upper" and "lower" are intended to facilitate the description of the adjustable reflector assembly. Such terms are merely illustrative of the reflector assembly and do not limit the reflector assembly to any specific orientation.

BRIEF DESCRIPTION OF THE DRAWINGS

Referring to the drawings which form a part of this disclosure.

DETAILED DESCRIPTION OF THE PREFERRED EMBODIMENT

Figure 1:
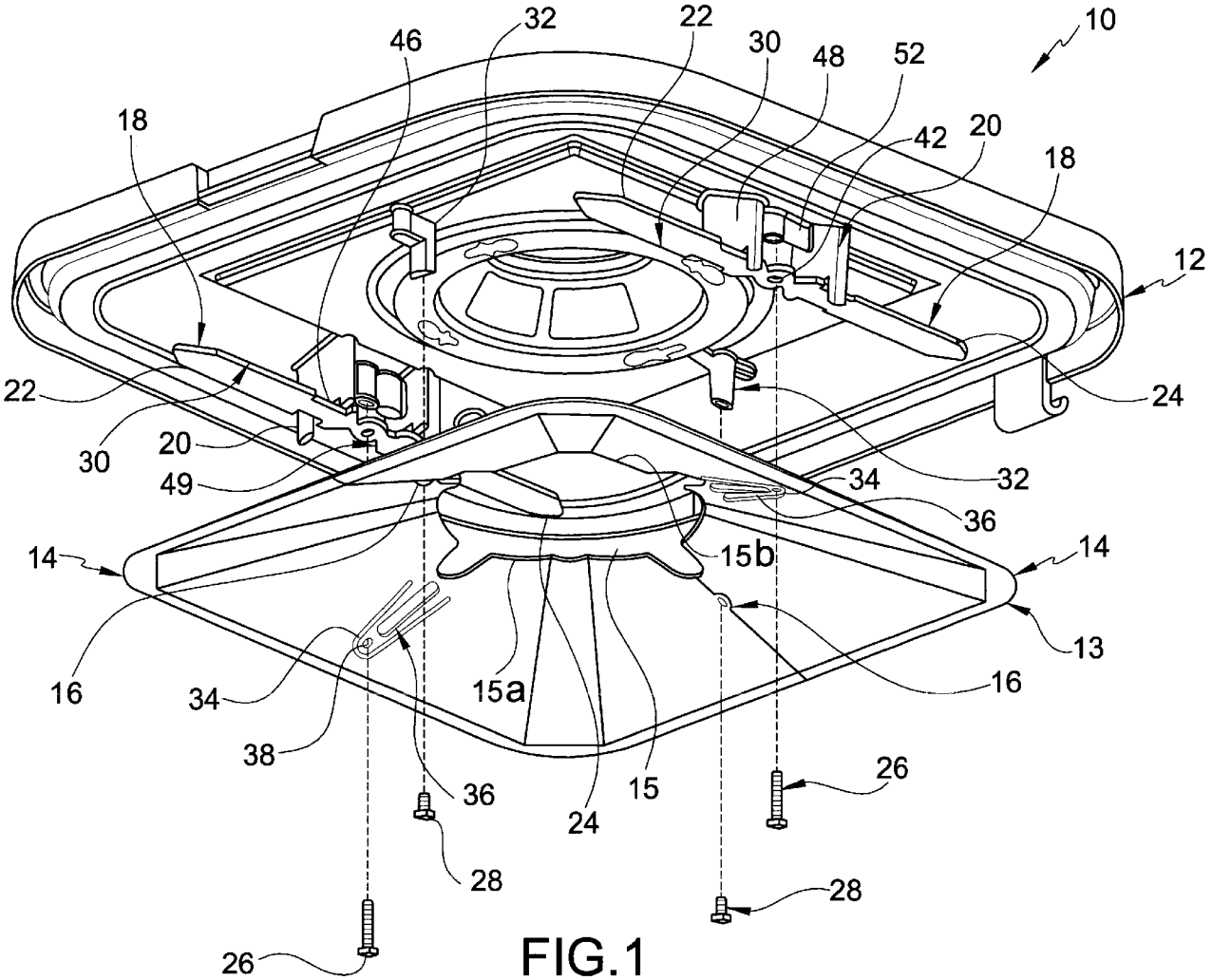
FIG. 1 is bottom perspective view of a lighting fixture base with an adjustable reflector assembly, in accordance with the present invention.
Figure 2:
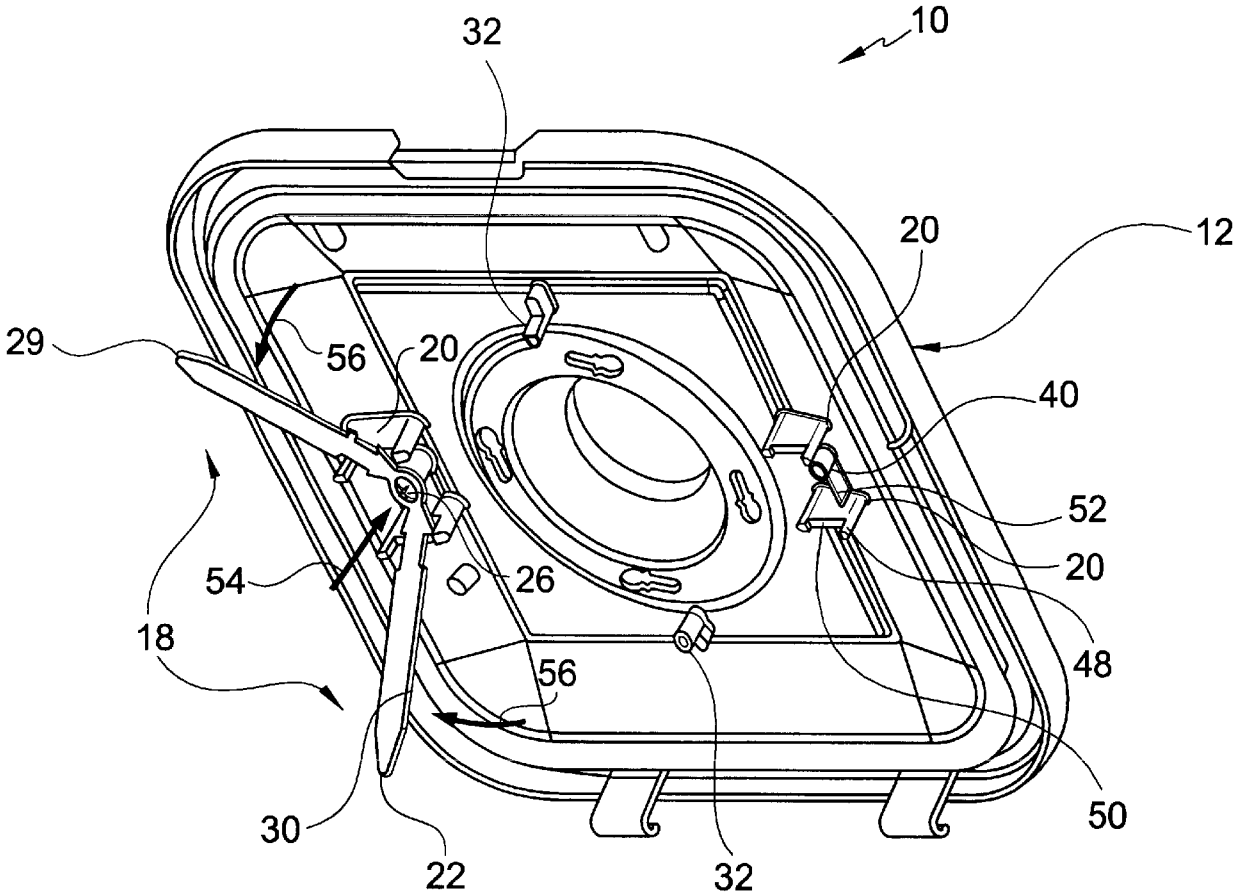
FIG. 2 is a bottom perspective view of the lighting fixture base of FIG. 1 without the adjustable reflector to show a deployment bar pivoted around the mounting bar.

Referring to FIGS. 1 and 2, a lighting fixture or luminaire base or mounting member 10, according to the present invention, has a frame 12 supporting a reflector 13 formed of a pair of adjustable reflector parts 14 connected through interlocking tabs 16. The reflector parts rest on deployment bars 18, which are supported by mounting bars 20. The deployment bar ends 22 and 24 are bent in an downward direction when actuation screws 26 are turned in one direction. The bar ends then reposition the reflectors, changing the direction of the light emitted from the luminaire.

Preferably, each reflector part 14 is a metal rectangle with semicircle 15*a* and 15*b* cut out of one of the longer sides, allowing the reflector, when its parts are connected together, to have a substantially square base with the sides tapered to form a shape similar to a pyramid. However, the reflector may be of any suitable shape, such as a cone, enabling the reflectors to substantially cover the interior of the frame and to adequately direct the light emitted. Semicircles 15*a* and 15*b* cut out of each reflector part 14 creates at the pinnacle of reflector 13, a generally circular hole 15 to accommodate a light source. Interlocking tabs 16 and screws 28 connect the reflector parts to each other. Screws 28 pass through the interlocking tabs on each reflector part and engage raised, internally threaded studs 32. The interlocking tabs 16 and screws 28 secure the reflector to the frame and hold the reflector parts together, while still allowing the reflector to move when influenced by the deployment bars.

Integral to each reflector is a U-shaped cut out creating a flexible deployment or tension tab 34 in one side of each reflector part. Each tension tab has a strengthening rib 36 and a screw hole 38. Screw holes 38 are positioned under the mounting bars 20 and shorter internally threaded studs 40. Actuation screws 26 pass through screw holes 38 and deployment bars 20 and into studs 40. Screws 26 attach the reflector to the deployment bars. The bending of tension tabs 34 enables the reflector to be fixedly connected at interlocking tabs 16 and still be repositioned or bent by the ends of deployment bars 18.

Figure 3:
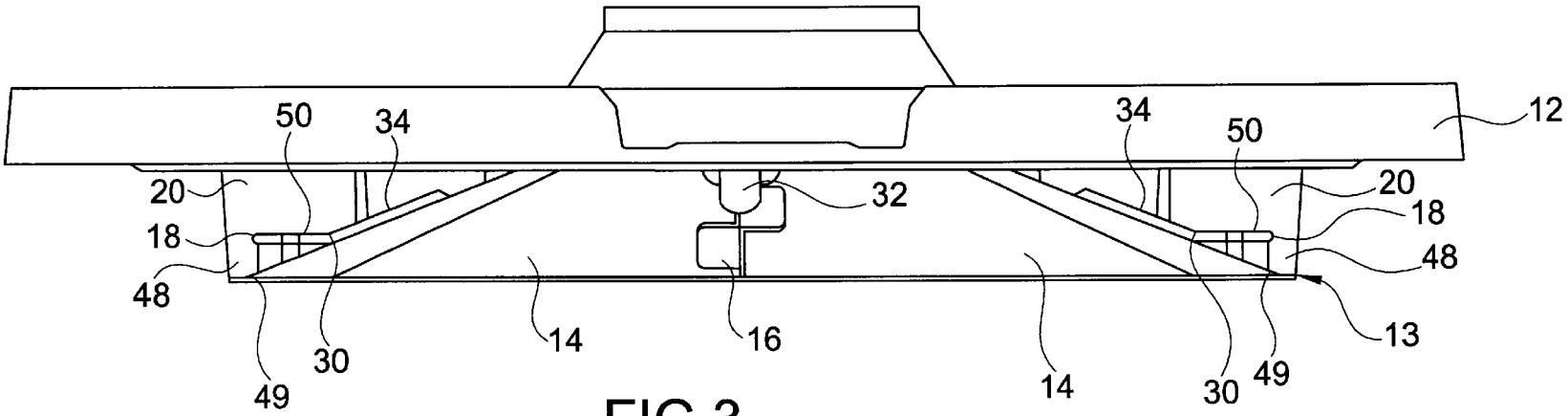
FIG. 3 is a side elevational view of the lighting fixture base of FIG. 1 along the transverse axis of the deployment bars in their standard or initial position.

Deployment bars 18 are generally rectangular metal bars that support and control the reflectors 14. Deployment bars 18 rest directly on mounting bars 20 and extend beyond the mounting bars. Deployment bar ends 22 and 24 taper into a point. The width of the deployment bars is sufficient so that the bar inside edges 30 contact the reflector in its standard or initial position. As shown in FIGS. 1 and 3, the standard position is when the deployment bars are flat (planer) and unbent with actuation screws 26 tightened sufficiently to have the reflector contact the deployment bars. This geometry applies pressure on the deployment bars and keeps them from rattling during installation and operation.

In the center of each deployment bar is an unthreaded hole 42, through which actuation screw 26 passes. To either side of and equidistant from the center hole 42 are two deep bending notches 44. The deep bending notches allow the ends of the deployment bars to pivot downwardly when upward pressure is applied to the center of the bar. In addition, deployment bars 18 have two sets of positioning notches 46 on the edges of the deployment bars equidistant from center hole 42, but are further from the center of the bars than bending notches 44. The positioning notches are rectangular cutouts along the longitudinal edge of the bars and enable the deployment bars to nest in a recessed sections 50 of the mounting bars and help to stop twisting and sliding of the deployment bars. The positioning notches, when the deployment bar is in its planer or standard position, abut the mounting bars restricting the movement of the deployment bars. However, the positioning notches are designed long enough so that when the deployment bar center is bent upwardly, the positioning notches will slide along the recessed sections 50 and still restrict the twisting motion of the deployment bars.

Figure 4:
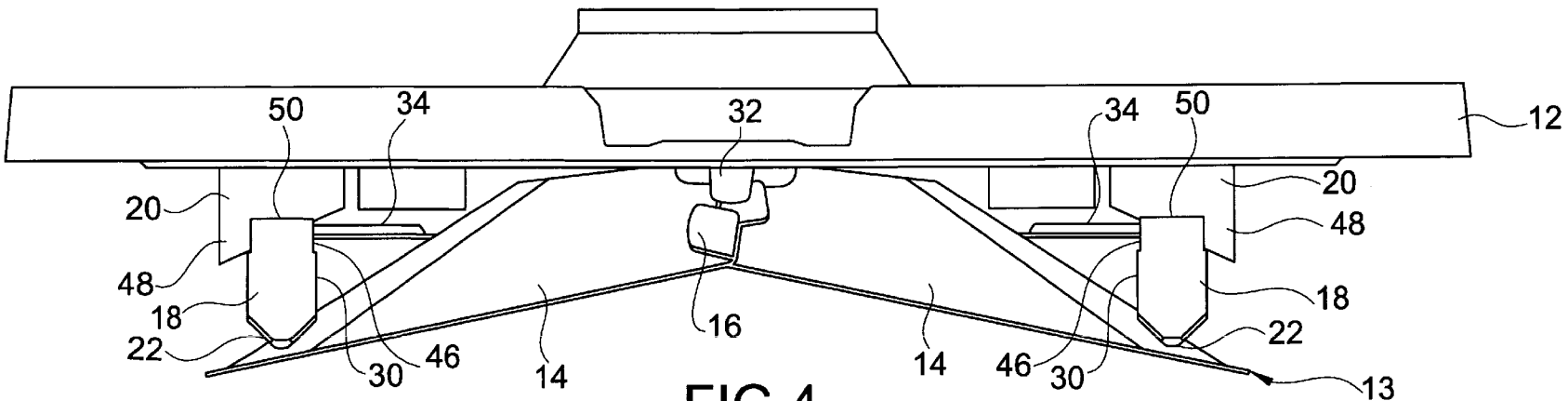
FIG. 4 is a side elevational view along the transverse axis of the deployment bars of FIG. 3 with the reflector assembly repositioned by the deployment bars.
Figure 5:
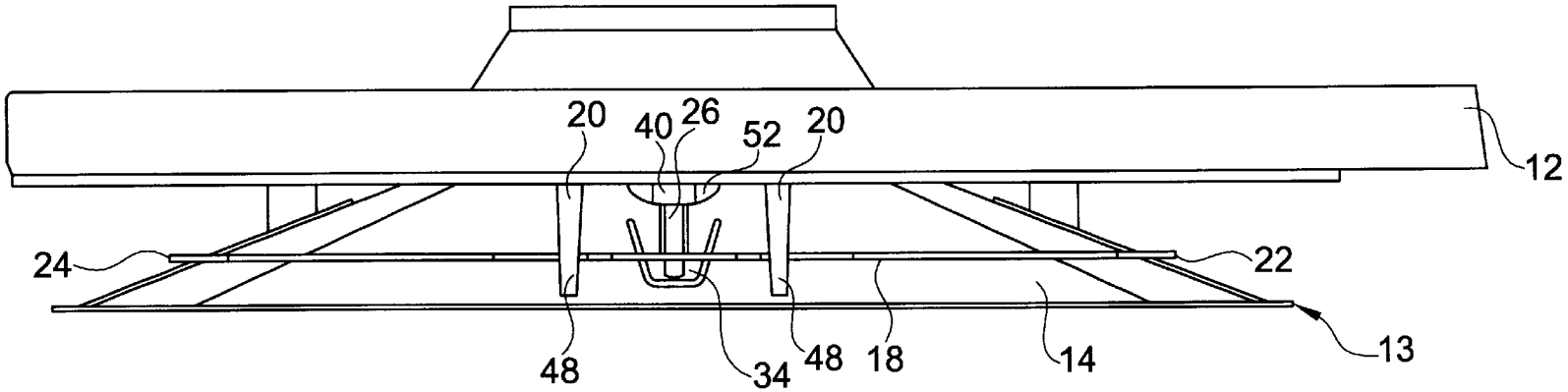
FIG. 5 is a side elevational view of the lighting fixture base of FIG. 1 along the longitudinal axis of the deployment bars in their standard or initial position.
Figure 6:
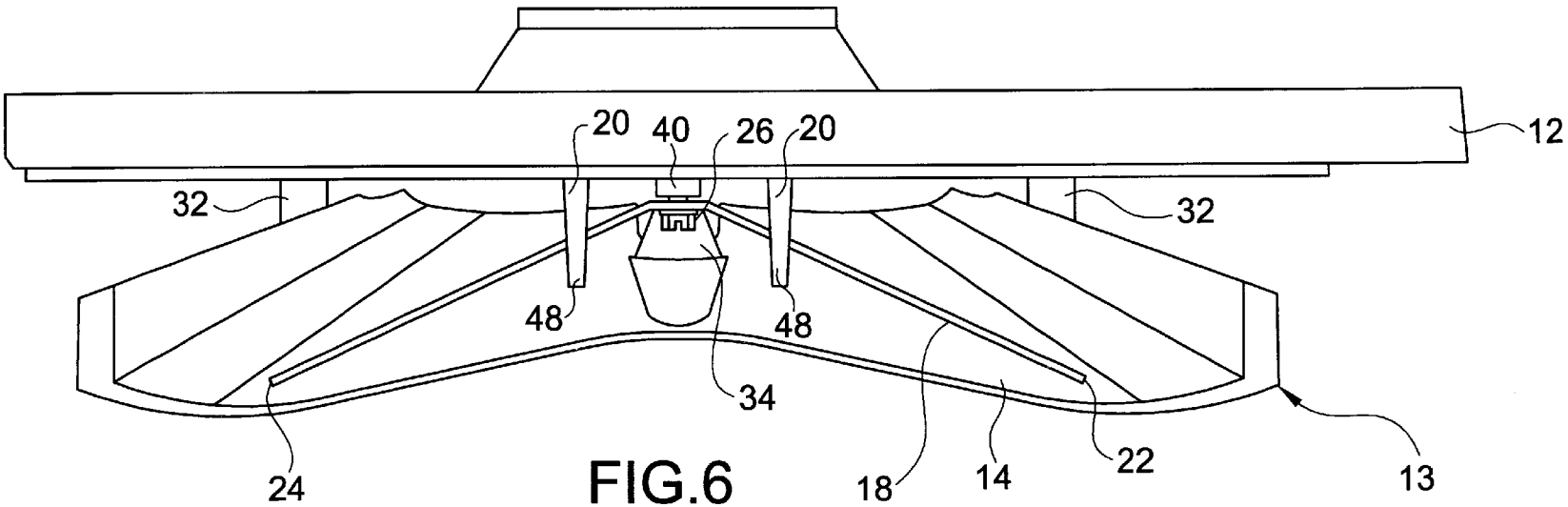
FIG. 6 is a side elevational view along the longitudinal axis of the deployment bars of FIG. 5 with the reflector assembly repositioned by the deployment bars.

Mounting bars 20 are integrally molded with the frame 12 and support deployment bars 18 and reflector 13. As shown in FIGS. 3 and 4, the mounting bars have two thin raised trapazoidal regions 48 that are slightly wider than deployment bars 18. The trapazoidal shape allows the reflector when in its initial configuration to lay along angled side 49 of the mounting bar. Each of raised regions has a recessed section 50 molded into angled side 49 that allows deployment bar positioning notches 46 to rest. As stated above, the positioning notches and the recessed section interact to hold deployment bars 19 in place and center holes 42 over studs 40. As shown in FIG. 1, each stud 40 is located in a lowered region 52 of the center of the respective mounting bar 20 allowing the deployment bars to bend.

The procedure for repositioning one or both of the reflector parts is the same. Using a screwdriver, one actuation screw 26 is turned clockwise. This rotation threads that screw 26 into the respective stud 40 and applies pressure to the center of deployment bar 18 toward that stud. As shown in FIGS. 2 and 4, due to the deep bending notches 44, the center of the deployment bar is pushed upwardly in between the raised regions 48 of mounting bars 20 in the direction of arrow 54, towards internally threaded stud 40. This raises the center of the deployment bar causing the bar end portions to pivot downwardly about the axes of notches 44 on the mounting bars in the direction of arrows 56. The lowering of the ends of the bars pushes the associated reflector part downwardly and moves the top edge of the reflector towards the center of the light. The bottom of the reflector part is held stationary by the interlocking tabs 16 and screws 28. If additional adjustments are desired, the interlocking tab screws can be loosened allowing the reflector sides to move up.

This deployment system is not limited to any specific number of adjustable reflectors and functions in the same manner regardless of whether there are one, two, or more reflectors.

While a particular embodiment has been chosen to illustrate the invention, it will be understood by those skilled in the art that various changes and modifications can be made therein without departing from the scope of the invention as defined in the appended claims. This is accomplished by the tension tabs bending down with the center of the deployment bars and the rest of the reflector bending away from the center of the deployment bar, due to the pressure applied by the pivoting ends of the deployment bar.

What is claimed is:

1. A reflector assembly device, comprising:

a reflector mounted on a base;

a deployment bar mounted on the base adjacent the reflector; and an actuation screw engaging said reflector and said deployment bar and threadly engaged with said base;

whereby threading said actuation screw into said base changes positioning of the deployment bar and in turn changes positioning of said reflector.

2. A reflection device according to claim 1 wherein said base includes a mounting bar extending therefrom by a first distance and supporting said deployment bar.

3. A reflection device according to claim 2 wherein said base includes a threaded stud extending therefrom by a second distance less than said first distance.

4. A reflector assembly according to claim 3 wherein said actuation screw passes through said reflector and said deployment bar and engages said threaded stud.

5. A reflector assembly according to claim 4 wherein said reflector has a flexible tension tab; and said actuation screw passes through said flexible tension tab.

6. A reflector assembly according to claim 5 wherein said flexible tension tab has a strengthening rib.

7. A reflector assembly according to claim 6 wherein said flexible tension tab is defined by a U-shaped cut in said reflector.

8. A reflector assembly according to claim 1 wherein said reflector comprises two mating reflector parts, with each of said parts having a locking tab enabling said reflector parts to be coupled with one another.

9. A reflector assembly, comprising:

first and second reflectors mounted on a base and coupled together using interlocking tabs, said first and second reflectors having first and second flexible tension tabs;

first and second deployment bars mounted on a base for supporting and adjusting said first and second reflectors; and first and second actuation screws passing through said first and second flexible tension tabs and threadly engaging said base, said first and second actuation screws coupling said first and second reflectors to said first and second mounting bars, and situated to bend said first and second deployment bars upon threading of said actuation screws into said base, said bending of first and second deployment bars adjusting first and second reflectors.

10. A reflector assembly according to claim 9 wherein said deployment bars are substantially rectangular.

11. A reflector assembly according to claim 10 wherein said deployment bars have four bending notches along the longitudinal sides, said bending notches being radially equidistant from the center of said deployment bar.

12. A reflector assembly according to claim 11 wherein said deployment bars have four positioning notches radially equidistant from the center of the deployment bars and along the longitudinal sides of said deployment bars, said positioning notches located farther from the center than said bending notches.

13. A reflector assembly according to claim 9 wherein said first and second flexible tension tabs are defined by a U-shaped cut in said reflectors.

14. A reflector assembly according to claim 13 wherein said first and second flexible tension tabs have strengthening ribs.

15. A lighting fixture assembly, comprising:

an adjustable light reflector mounted on a base;

a mounting bar molded as part of said base, extending therefrom by a first distance and supporting said reflector;

a substantially rectangular deployment bar resting between said mounting bar and said reflector and having two ends, a hole through the center, a set of bending notches along the longitudinal edges, all equidistant from said center hole, and a set of positioning notches, all equidistant from said center hole, farther from said center hole than said set of bending notches, said positioning notches holding said deployment bar stationary with respect to twisting movement;

a stud molded as part of said base and located in the center of said mounting bar; and an actuation screw passing through said adjustable reflector and said center hole in said deployment bar and threadly engaging said stud, said actuation screw altering the position of the deployment bar upon threading said actuation screw into said base, which in turn adjusts the position of said reflector.

16. A lighting fixture assembly according to claim 15 wherein said stud extends from said base by a second distance less than said first distance.

17. A lighting fixture assembly according to claim 16 wherein said actuation screw alters the position of said deployment bar by applying pressure at said center hole of said deployment bar when said actuation screw is threaded into said stud, pushing the center of said deployment bar towards said stud, causing the deployment bar to bend at said bending notches and pivoting the deployment bar ends in a direction toward said reflector.

18. A lighting fixture assembly according to claim 16 wherein said pivoting of the ends of said deployment bar adjusts said reflector.

19. A lighting fixture assembly according to claim 15 wherein said reflector has a flexible tension tab.

20. A lighting fixture assembly according to claim 19 wherein said flexible tension tab has a strengthening rib.

21. A reflector assembly according to claim 1, wherein said deployment bar is located between said reflector and said base.

22. A reflector assembly according to claim 2, wherein said deployment bar is located between said reflector and a portion of said mounting bar.

23. A reflector assembly device according to claim 1, wherein said deployment bar is pivotollay adjustable relative to said base.

24. A reflector assembly device according to claim 1, wherein said deployment bar and said reflector adjustable bend under forces generated by said actuation screw.

25. A reflector assembly device according to claim 1, wherein said deployment bar has a set of bending notches, and said deployment bar bends at said bending notches when changing position.

26. A reflector assembly device according to claim 1, wherein said deployment bar has positioning notches, said positioning notches holding said deployment bar stationary with respect to twisting movement.

27. A reflector assembly according to claim 9, wherein said deployment bar is located between said reflector and said base.

28. A reflector assembly according to claim 9, wherein said deployment bar is located between said reflector and a portion of said mounting bar.

* * * * *